US007347753B1

(12) United States Patent
Caldwell et al.

(10) Patent No.: US 7,347,753 B1
(45) Date of Patent: Mar. 25, 2008

(54) HYDRAULIC ACTUATION SYSTEM FOR A MARINE PROPULSION DEVICE

(75) Inventors: Rodney M. Caldwell, Pawnee, OK (US); Kyle D. George, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 7 days.

(21) Appl. No.: 11/544,880

(22) Filed: Oct. 5, 2006

(51) Int. Cl.
*B63H 5/125* (2006.01)
*B63H 20/08* (2006.01)

(52) U.S. Cl. ..... 440/61 R; 440/61 S; 440/61 T; 440/61 F; 440/61 G; 440/57; 114/150

(58) Field of Classification Search ..... 440/61 R, 440/61 T, 61 F, 61 G, 61 J, 61 H, 61 D, 440/61 E, 57; 114/150; 92/60
See application file for complete search history.

(56) References Cited

U.S. PATENT DOCUMENTS

| | | | | |
|---|---|---|---|---|
| 2,946,316 | A * | 7/1960 | Lawrence | 92/60 |
| 3,599,595 | A | 8/1971 | James | 115/34 |
| 4,363,629 | A | 12/1982 | Hall et al. | 440/61 |
| 4,645,464 | A | 2/1987 | Rawlings | 440/57 |
| 5,203,730 | A | 4/1993 | Kuragaki | 440/61 |
| 6,176,170 | B1 | 1/2001 | Uppgard et al. | 91/422 |
| 6,296,535 | B1 | 10/2001 | Bland et al. | 440/61 |
| 6,454,620 | B1 * | 9/2002 | Theisen et al. | 440/61 R |
| 6,468,120 | B1 | 10/2002 | Hasl et al. | 440/61 |
| 6,607,410 | B1 | 8/2003 | Neisen et al. | 440/57 |
| 6,656,004 | B2 | 12/2003 | Bland et al. | 440/61 |
| 6,830,492 | B1 | 12/2004 | Magee et al. | 440/61 R |

* cited by examiner

*Primary Examiner*—Lars A Olson
*Assistant Examiner*—Daniel V Venne
(74) *Attorney, Agent, or Firm*—William D. Lanyi

(57) ABSTRACT

A hydraulic system for a sterndrive marine propulsion device directs the flow of hydraulic fluid through the body and peripheral components of a gimbal ring in order to reduce the number and length of flexible hydraulic conduits necessary to conduct pressurized hydraulic fluid from a pump to one or more hydraulic cylinders used to control the trim or tilt of a marine drive unit relative to a gimbal housing.

12 Claims, 8 Drawing Sheets

HYDRAULIC ACTUATION SYSTEM FOR A MARINE PROPULSION DEVICE

BACKGROUND OF THE INVENTION

1. Field of the Invention

The present invention is generally related to a marine propulsion device and, more particularly, to a hydraulic actuation system that routes a hydraulic conduit through the body of a portion of the marine propulsion device structure.

2. Description of the Related Art

Those skilled in the art of marine propulsion devices are familiar with many different hydraulic applications related to marine vessels and propulsion devices and, in addition, are familiar with various optional techniques that can be used to conduct the flow of pressurized hydraulic fluid between components of the marine propulsion device.

U.S. Pat. No. 3,599,595, which issued to James on Aug. 17, 1971, describes an outdrive for boats which has a hydraulic pump including an eccentric ring which is rotatable to change the path of fluid flow under pressure so that the direction of drive of the motor can be easily reversed. Hydraulic fluid may be subjected to pressure with structure prior to communication thereof to the hydraulic pump. A transom bracket and sterndrive housing support are connected so as to provide pivotal movement of the sterndrive housing along two mutually perpendicular axes so that the sterndrive housing will remain in the water even when the boat negotiates a sharp turn, the transom bracket being provided with couplings to accommodate fluid flow therethrough and a fluid restraining recess to allow recirculation of cooling water through a driving engine carried by the boat.

U.S. Pat. No. 4,363,629, which issued to Hall et al. on Dec. 14, 1982, describes a hydraulic system for an outboard motor with sequentially operating tilt and trim means. The device comprises a transom bracket adapted to be connected to a boat transom, a first pivot connecting a stern bracket to the transom bracket for pivotal movement of the stern bracket relative to the transom bracket about a first pivot axis which is horizontal when the transom bracket is boat mounted, a second pivot connecting a swivel bracket to the stern bracket below the first pivot for pivotal movement of the swivel bracket with the stern bracket and relative to the stern bracket about a second pivot axis parallel to the first pivot axis and a king pin pivotally connecting a propulsion unit including a rotatably mounted propeller to the swivel bracket for steering movement of the propulsion unit relative to the swivel bracket about a generally vertical axis and for common pivotal movement with the swivel bracket in a vertical plane about the first and second horizontal axes.

U.S. Pat. No. 4,645,464, which issued to Rawlings on Feb. 24, 1987, describes a steering and tilting means for a marine propulsion device. The device comprises a gimbal housing adapted to be fixedly mounted on a boat transom, a gimbal ring pivotally mounted on the gimbal housing for pivotal movement relative to the gimbal housing about a generally vertical steering axis and a support arm extending rearwardly from the lower end of the gimbal ring.

U.S. Pat. No. 5,203,730, which issued to Kuragaki on Apr. 20, 1993, describes a tilting system for an outboard drive unit. A conduit arrangement in a hydraulic tilting system for an outboard drive unit is described wherein a plurality of connecting members are provided, one mounted at the lower end of the gimbal housing and two mounted on the outer periphery of the gimbal housing higher than the upper connecting member but lower than the tilt shaft on the gimbal ring.

U.S. Pat. No. 6,176,170, which issued to Uppgard et al. on Jan. 23, 2001, discloses a hydraulic actuator with shock absorbing capability. The actuator comprises a cylinder with first and second pistons slidably disposed therein. The first and second pistons are movable relative to each other. A poppet is supported by the first piston and is movable relative to the first piston. In response to hydraulic fluid pressure within a passage of the first piston, the poppet can be caused to move in a direction which opens a passage through the first piston to allow the first piston to move relative to the second piston in response to a shock impact such as that which can result from an outboard motor striking a submerged or floating object.

U.S. Pat. No. 6,296,535, which issued to Bland et al. on Oct. 2, 2001, describes a tilt-trim subsystem for boats using a sterndrive system. The subsystem assembly is affixed to an outdrive of a sterndrive that may be supported by a gimbal unit and may be configured to rotate about a predetermined axis to impart a desired trim or tilt to the drive system. The tilt-trim assembly has one respective end thereof configured to pivotally receive one anchor pin supported by the outdrive. The assembly includes one or more cylinders having one end thereof pivotally connected to another anchor pin so that when the cylinder is actuated the outdrive and the tilt-trim subsystem assembly are jointly rotated about the predetermined axis.

U.S. Pat. No. 6,454,620, which issued to Theisen et al. on Sep. 24, 2002, discloses an integrated external hydraulic trimming and steering system for an extended sterndrive transom assembly. The marine propulsion system is provided with a drive unit that is attachable to a transom of a marine vessel and provided with steering cylinder assemblies and trimming cylinder assemblies which are connected to a common location on a structure member, such as a gimbal ring. This arrangement improves the geometric relationship between the steering and trimming functions. In addition, the hydraulic steering system is provided with pressure relief valves that are located at the transom of the marine vessel in order to shorten the distance of the hydraulic conduits extending between the pressure relief valves and the steering cylinders.

U.S. Pat. No. 6,468,120, which issued to Hasl et al. on Oct. 22, 2002, describes a single cylinder trim/tilt assembly. It includes a shield assembly for being secured to a transom of the boat. A gimbal ring is pivotally coupled to the shield assembly at an axis of rotation. A drive frame is pivotably connected to the gimbal ring so that the drive frame pivots in conjunction with the gimbal ring. A single trim cylinder is included that has a first end connected to the gimbal ring and a second end connected to the drive frame. The trim cylinder has a cylinder rod and a cylinder housing and the cylinder rod is movable within the cylinder housing.

U.S. Pat. No. 6,607,410, which issued to Neisen et al. on Aug. 19, 2003, describes a single cylinder tilt-trim assembly for boats using a sterndrive system. A sterndrive system is described which has an outdrive rotatable about a generally horizontal axis to impart a desired trim or tilt to the drive system. The system includes a gimbal ring that defines an inner region. The gimbal ring is configured to pivotally receive a first anchor pin. A tilt-trim assembly is affixed to the outdrive and the tilt-trim assembly has one respective end thereof configured to pivotally receive a second anchor pin supported by the outdrive.

U.S. Pat. No. 6,656,004, which issued to Bland et al. on Dec. 2, 2003, describes a tilt-trim subsystem for boats using a sterndrive system. The assembly is fixed to an outdrive of a sterndrive which may be supported by a gimbal unit and may be configured to rotate about a predetermined axis to impart a desired trim or tilt to the drive system. The assembly has one end thereof configured to pivotally receive one anchor pin supported by the outdrive. The assembly includes one or more cylinders having one end thereof pivotally connected to another anchor pin so that when the cylinder is actuated the outdrive and the tilt-trim subsystem assembly are jointly rotated about the predetermined axis.

U.S. Pat. No. 6,830,492, which issued to Magee et al. on Dec. 14, 2004, discloses a marine drive trim cylinder with a two stage damping system. The system is provided for a trim cylinder mount of a marine drive unit. The mounting bushings comprise inner and outer tubes with an elastomeric material disposed between the inner and outer tubes. The elastomeric material is structure to provide a soft rate of stiffness in response to relatively light loads, such as shifting loads, and a harder rate of stiffness in response to higher loads, such as during high thrust loads or wide open throttle operation of a marine vessel.

The patents described above are hereby expressly incorporated by reference in the description of the present invention.

SUMMARY OF THE INVENTION

A hydraulic actuation system for a marine propulsion device, made in accordance with a preferred embodiment of the present invention, comprises a gimbal housing which is attachable to a marine vessel and a gimbal ring which is rotatably attached to the gimbal housing for rotation about a steering axis. It also comprises a bell housing which is rotatably attached to the gimbal ring for rotation about a tilt axis. Throughout the description of the preferred embodiment of the present invention, it should be understood that the particular names assigned to these components are not limiting. In other words, the gimbal housing is any appropriate structure configured to be attached to the marine vessel for the purpose of supporting the drive unit. The gimbal ring is any device which is rotatably supported for rotation about a steering axis. The bell housing is any appropriate structure which is rotatably supported and which is configured to rotate about a tilt axis of the marine propulsion device. In a typical application, the driveshaft housing and gear case of the drive unit are supported by and attached to the bell housing.

A preferred embodiment of the present invention further comprises a hydraulic actuator, such as one or more hydraulic cylinders, connected between the gimbal ring and the bell housing. A fluid conduit is connected in fluid communication between a source of hydraulic pressure, such as a hydraulic pump, and the hydraulic actuator, such as the hydraulic cylinder. The conduit comprises a passage which is formed through the body of the gimbal ring. The conduit is configured to conduct hydraulic fluid between the hydraulic pump, or other source of hydraulic pressure, and the hydraulic actuator, such as the hydraulic cylinder. The conduit is also configured to conduct hydraulic fluid through the passage which is formed through the body of the gimbal ring. In a particularly preferred embodiment of the present invention, it further comprises a fluid manifold connected in fluid communication with the conduit and with the source of hydraulic pressure. The source of hydraulic pressure can be a hydraulic pump and the fluid manifold can be attached for support to the gimbal housing. The present invention, in a preferred embodiment, further comprises first and second anchor pins extending coaxially from the gimbal ring to define the steering axis. The first and second hydraulic cylinders are rotatably supported by the first and second anchor pins.

In a particularly preferred embodiment of the present invention, the hydraulic actuator comprises first and second hydraulic cylinders. The first and second anchor pins are threaded into a main body of the gimbal ring and the passage extends through the first and second anchor pins to connect the first and second hydraulic cylinders in fluid communication with the source of hydraulic pressure. The passage which is formed through the body of the gimbal ring can comprise first and second channels connected in fluid communication between the source of hydraulic pressure and the first hydraulic cylinder. Third and fourth channels are connected in fluid communication between the source of hydraulic pressure and the second hydraulic cylinder. The first and second channels extend through the first anchor pin and the third and fourth channels extend through the second anchor pin. In a preferred embodiment of the present invention, the conduit comprises first and second pairs of flexible tubes connected between the fluid manifold and the passage formed through the body of the gimbal ring.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
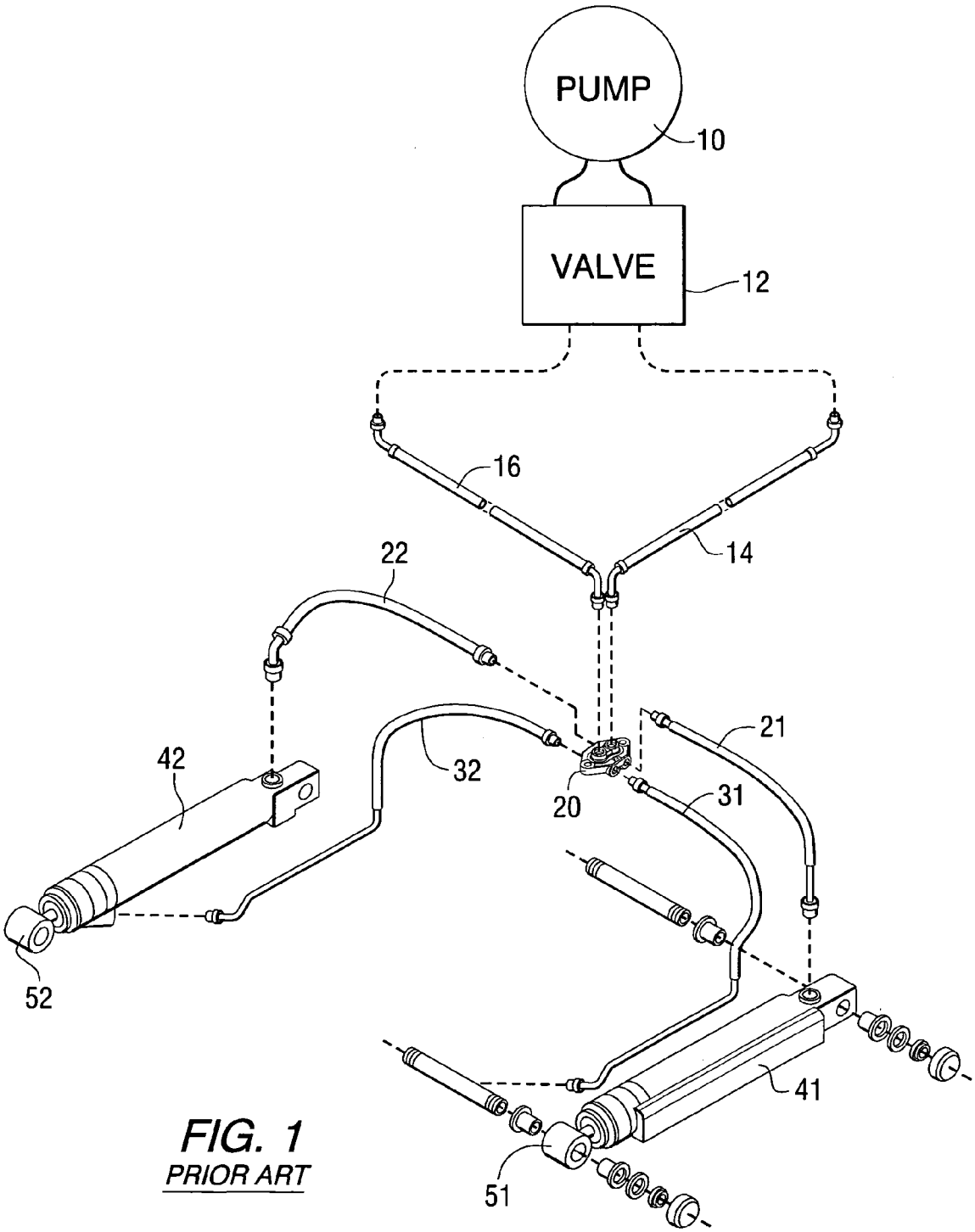
FIG. 1 PRIOR ART
FIG. 1 is an isometric exploded view of a known type of hydraulic system for a sterndrive unit.

Throughout the description of the preferred embodiment of the present invention, like components will be identified by like reference numerals.

FIG. 1 illustrates a known type of hydraulic system for providing hydraulic fluid, under pressure, to a hydraulic actuation system, comprising two hydraulic cylinders, to affect the tilt, or trim, position of a marine propulsion device, such as a sterndrive unit. Although the sterndrive unit is not illustrated in FIG. 1, for purposes of clarity and simplicity, those skilled in the art of sterndrive propulsion systems are very well aware of the basic components and structure associated with a sterndrive system.

A pump 10 provides pressurized fluid, through a valve 12, to an extension conduit 14 and a retraction conduit 16. The valve 12 is controlled to determine which of the extension and retraction conduits, 14 or 16, is pressurized and which operates as a return line to the pump 10. A manifold 20 allows two flexible extension conduits, 21 and 22, to selectively receive pressurized hydraulic fluid from the primary extension conduit 14. Similarly, two retraction conduits, 31 and 32, are connected to the manifold 20 to allow pressurized fluid to be conducted to the two hydraulic cylinders, 41 and 42. As a result, a change in status of the valve 20 provides pressurized hydraulic fluid to both hydraulic cylinders, 41 and 42, to cause them to extend their piston rods, 51 and 52, or retract them in synchronized movement with each other. The other components shown in FIG. 1 relate to hardware used to connect the conduits to the hydraulic cylinders, 41 and 42, and to connect the hydraulic cylinders to other components of the sterndrive system. As will be described in greater detail below, the hydraulic cylinders, 41 and 42, are connected between a gimbal ring and a bell housing of the sterndrive unit. In addition, the gimbal ring is rotatably supported by a gimbal housing. As a result, conduits 21, 22, 31, and 32 are required to bend and twist in response to rotation of devices about two different axes. Depending on the overall space provided for the conduits, the required bending and twisting of the conduits about two different axes of rotation can lead to a deleterious situation and a circumstance where the configuration of the conduits can lead to damage and premature failure because of the twisting and bending of those conduits which occurs each time the sterndrive unit is steered about its generally vertical steering axis or tilted about its generally horizontal trim axis.

It is the purpose of the present invention to allow pressurized hydraulic fluid to be ported to the hydraulic cylinders of a sterndrive unit while avoiding the deleterious situation, described above, that can occur when those hydraulic conduits are bent and twisted when the sterndrive unit is steered or trimmed about its tilt axis.

Figure 2:
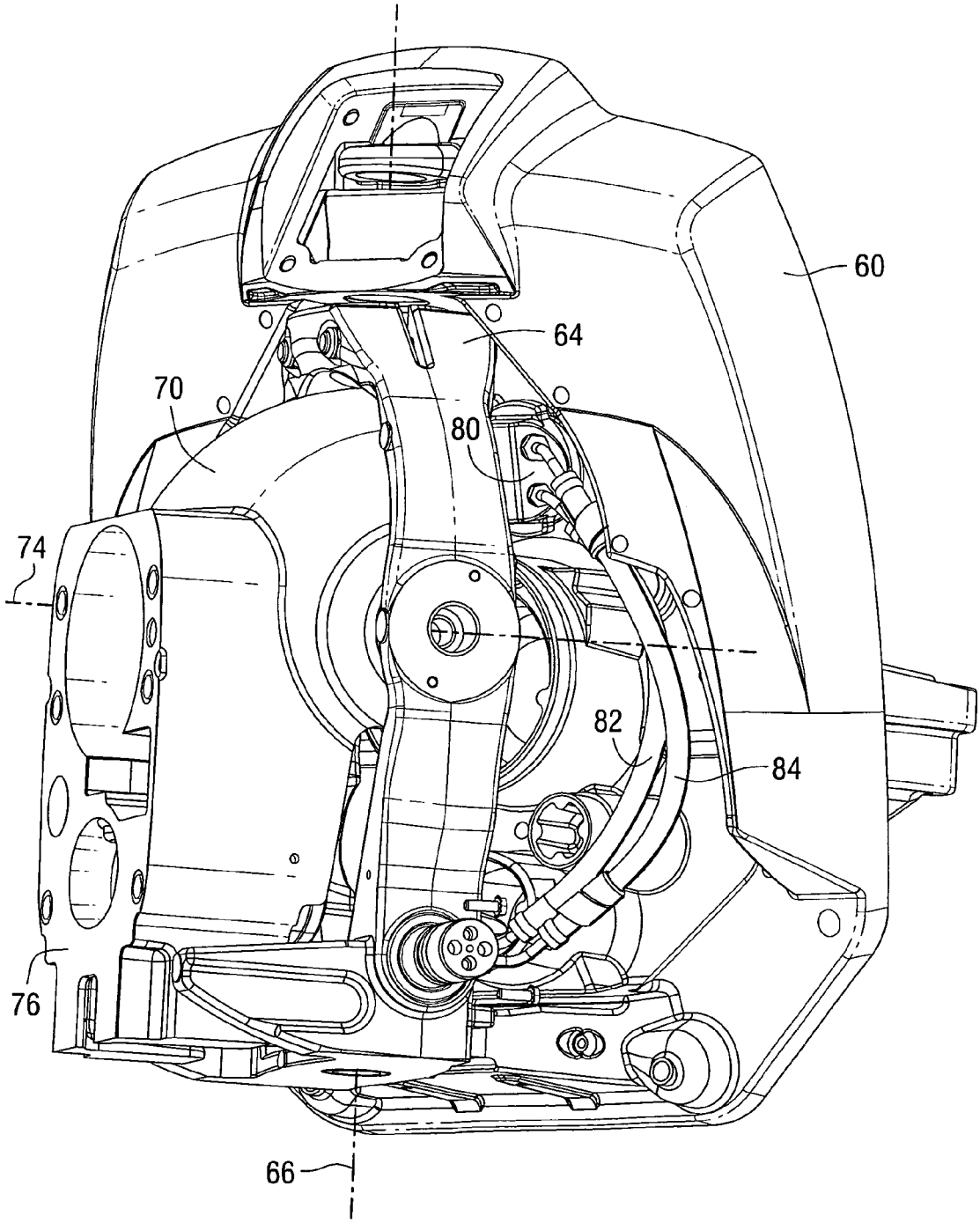
FIG. 2 is an isometric illustration of a preferred embodiment of the present invention.

FIG. 2 shows an isometric view of a preferred embodiment of the present invention. A gimbal housing 60 is shaped and configured to be attachable to a transom of a marine vessel. Although the marine vessel transom is not illustrated in FIG. 2, those skilled in the art of sterndrive units will recognize that the gimbal housing 60 is attached to the transom of a marine vessel in the manner similar to the configurations illustrated in U.S. Pat. Nos. 3,599,595 and 4,363,629. U.S. Pat. Nos. 5,203,730 and 6,296,535 also show the manner in which a gimbal housing is attached to the transom of a marine vessel. In addition, U.S. Pat. No. 6,454,620 shows the relative positions of a gimbal housing and a transom of a marine vessel when a sterndrive unit is attached as a propulsion system for the marine vessel.

A gimbal ring 64 is rotatably attached to the gimbal housing 60 for rotation about a generally vertical steering axis 66. In the patents discussed above, gimbal rings are illustrated and described in detail. In particular, U.S. Pat. No. 4,645,464 describes a particular type of gimbal ring and U.S. Pat. No. 6,607,410 illustrates and describes a different configuration of a gimbal ring.

With continued reference to FIG. 2, a bell housing 70 is supported by the gimbal ring 64 for rotation about a generally horizontal tilt axis 74. The surface 76 of the bell housing 70 is configured to receive an associated surface of a drive unit for support thereon in a manner which is very familiar to the skilled artisan. The drive unit is not illustrated in FIG. 2, but is described and illustrated in several of the patents discussed above.

A manifold 80 is attached for support to the gimbal housing 60. The manifold 80 of the present invention is generally similar in function to the manifold 20 described above in conjunction with FIG. 1. Like that known types is of manifold, the manifold 80 is connected to two hydraulic lines that conduct pressurized hydraulic fluid from a pump 10 through a valve 20. Those two hydraulic lines are not illustrated in FIG. 2, but function similar to the hydraulic conduits, 14 and 16, described above in conjunction with FIG. 1. Four hydraulic conduits are connected between the manifold 80 and two hydraulic cylinders (not shown in FIG. 2) in a preferred embodiment of the present invention. In FIG. 2, flexible hoses 82 and 84 are shown extending from the manifold 80 to a position on a rear surface of the gimbal ring 64.

Figure 3:
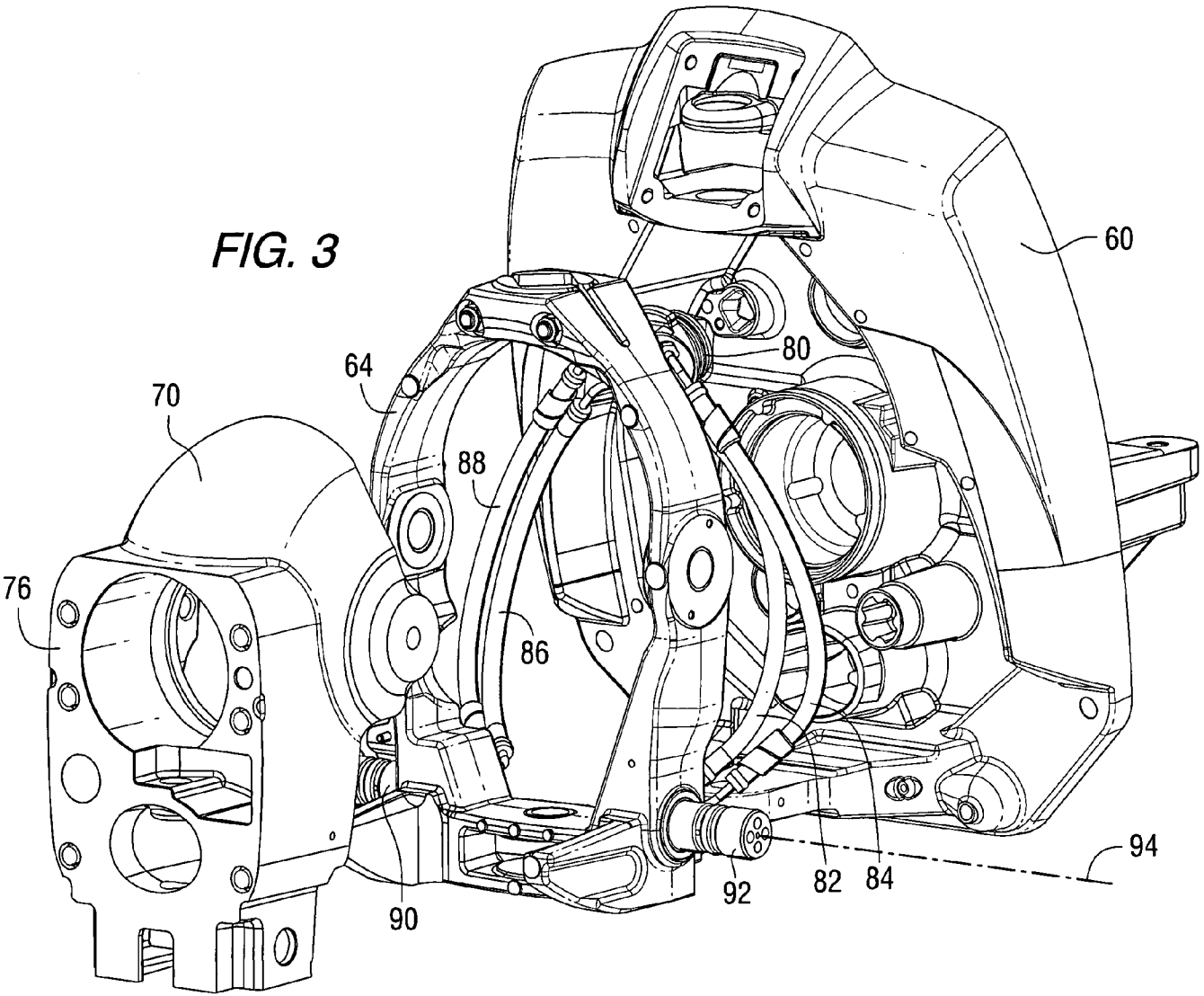
FIG. 3 is an exploded isometric representation of the preferred embodiment of the present invention.

FIG. 3 is an exploded isometric view of the assembly shown in FIG. 2. Although displaced from the gimbal housing 60, the gimbal ring 64 shown in FIG. 3 is rotatable about the steering axis 66 as illustrated in FIG. 2. Similarly, although the bell housing 70 is separated from the gimbal ring 64 in FIG. 3, it is rotatable about the generally horizontal tilt axis 74 as shown in FIG. 2. The exploded view of FIG. 3 more clearly shows the flexible hoses, or conduits identified by reference numerals 82, 84, 86, and 88. These conduits are connected between the manifold 80 and a surface (not visible in FIG. 3) of the gimbal ring 64.

Also shown in FIG. 3 are port 90 and starboard 92 anchor pins that extend from the gimbal ring and are coaxially aligned with each other and with axis 94. The anchor pins, 90 and 92, are shaped to support hydraulic cylinders which are connected between the gimbal ring 64 and the bell housing 70. Since the bell housing 70 is attached to the drive unit of the sterndrive system, it should be understood that the drive unit rotates with the bell housing 70. As a result, the hydraulic cylinders that are used to tilt or trim the drive unit can be attached to the drive unit itself or to the bell housing, for the purpose of causing the drive unit to rotate about the trim or tilt axis 74 described above in conjunction with FIG. 2. This selection of attachment location for the hydraulic cylinders is not limiting to the present invention. In fact, if the hydraulic actuator, such as the hydraulic cylinders, is attached between the gimbal ring and the bell housing, this attachment is generally equivalent in function and result to an attachment of the hydraulic actuator between the gimbal ring and the drive unit which, in turn, is attached to the bell housing 70. These options should be considered equivalent and within the scope of the present invention.

Figure 4:
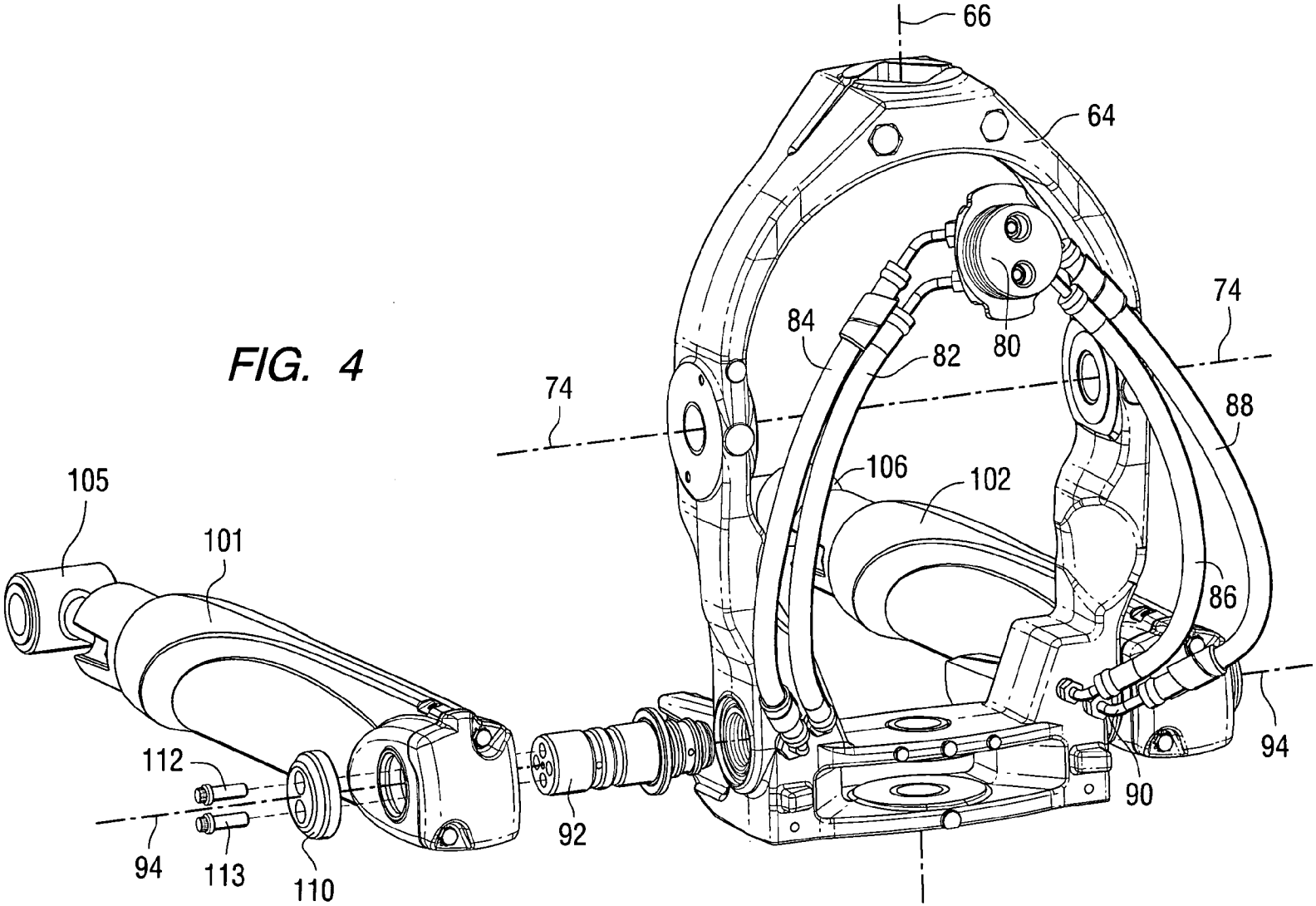
FIG. 4 is an isometric illustration showing a gimbal ring and hydraulic cylinders of a preferred embodiment of the present invention.

FIG. 4 is an exploded isometric view of a gimbal ring 64 and two associated hydraulic cylinders, 101 and 102. In addition to the gimbal ring 64, FIG. 4 also shows the manifold 80 and the four hydraulic hoses, or tubes, 82, 84, 86, and 88. The anchor pins, 90 and 92, are shown extending from the gimbal ring 64 and defining axis 94 about which the hydraulic cylinders, 101 and 102, are pivotable. The ends, 105 and 106, of the piston rods of the cylinders, 101 and 102, are also visible in FIG. 4. An end cap 110 and two fasteners, 112 and 113, are also shown in FIG. 4. The anchor pins, 90 and 92, are configured to support a selected end of the hydraulic cylinders, 101 and 102, for rotation about axis 94.

With continued reference to FIGS. 2-4, it can be seen that a hydraulic actuation system for a marine propulsion device, made in accordance with a preferred embodiment of the present invention, comprises a gimbal housing 60 which is attachable to a marine vessel, a gimbal ring 64 which is rotatably attached to the gimbal housing 60 for rotation about a steering axis 66, a bell housing 70 which is rotatably attached to the gimbal ring 64 for rotation about a tilt axis 74, and a hydraulic actuator, such as the hydraulic cylinders 101 and 102, connected between the gimbal ring 64 and the bell housing 70. It should be understood that the ends, 105 and 106, of the hydraulic cylinders, 101 and 102, might actually be attached to the drive unit itself instead of the bell housing 70, but the rigid attachment of the drive unit to the bell housing 70 causes the bell housing and drive unit to rotate in unison with each other and, therefore, attachment of the hydraulic actuator to the drive units, rather than the bell housing 70, is functionally equivalent to attachment to the bell housing 70. A conduit is connected in fluid communication between the source of hydraulic pressure, such as the pump 10 described above in conjunction with FIG. 1, and the hydraulic actuator, such as the hydraulic cylinders 101 and 102.

Figure 5:
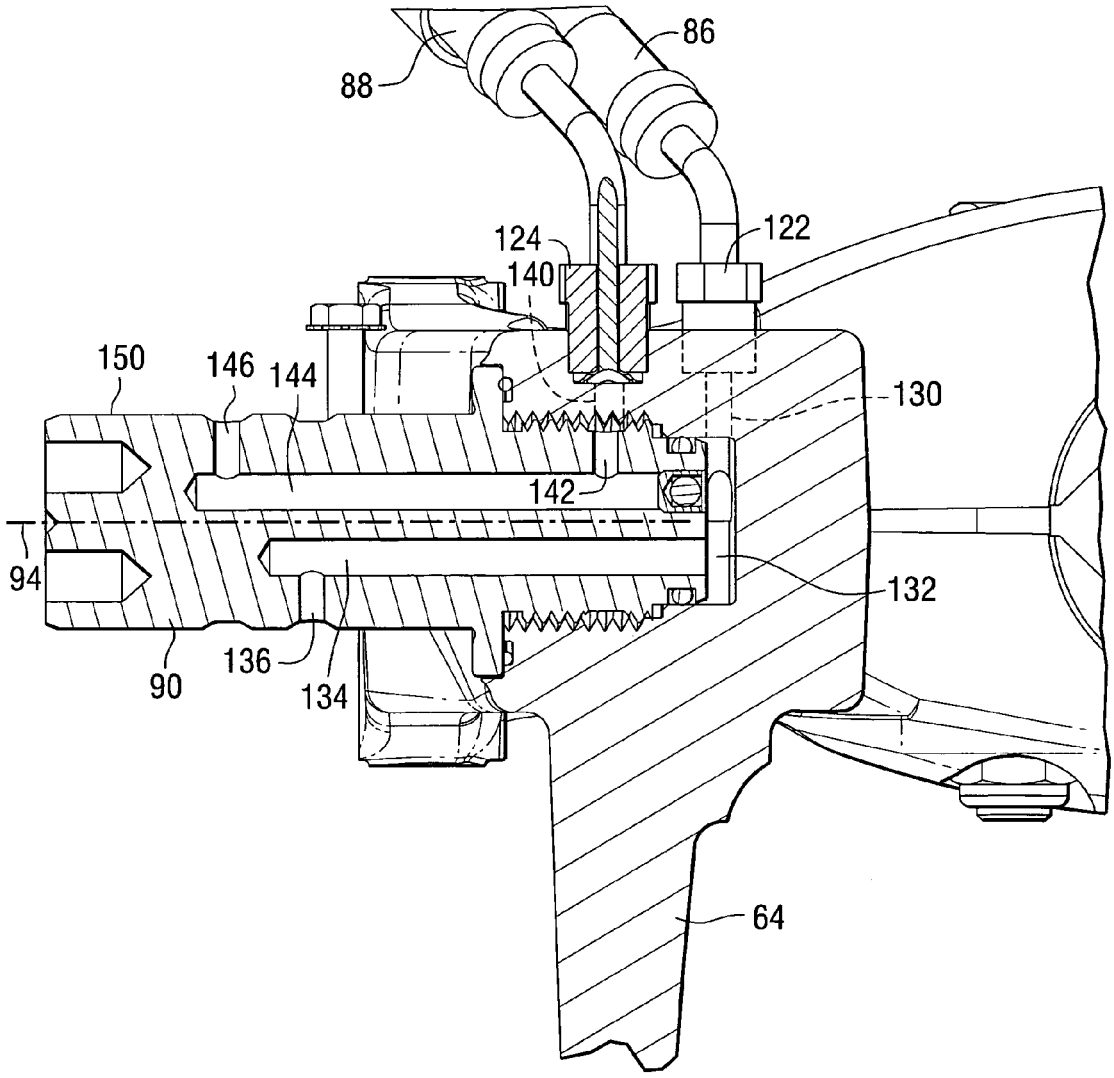
FIG. 5 is a section view taken through a portion of a gimbal ring and anchor pin.

FIG. 5 is a section view of a portion of the gimbal ring 64 showing the port anchor pin 90 threaded into it. The flexible tubes, 86 and 88, are illustrated in FIG. 5 in combination with their associated connectors, 122 and 124. Channels are formed through the body of the gimbal ring 64 to direct the flow of hydraulic fluid from the various conduits and connectors to passages formed within the anchor pins. As an example, the internal passage identified by reference numeral 130 directs hydraulic fluid from the flexible tube 86 and connector 122 to the passages within the anchor pin 90 that are identified by reference numerals 132, 134, and 136. Similarly, hydraulic fluid is directed by the passage 140 within the main structure of the gimbal ring 64 from conduit 88 in connector 124 to the passages within the anchor pin 90 identified by reference numerals 142, 144 and 146. Similar passages are formed through the other side of the gimbal ring 64 to provide a hydraulic fluid conduit between the flexible hoses identified by reference numerals 82 and 84 in FIG. 4 and the associated anchor pin 92.

As described above, the anchor pins are shaped to rotatably support the hydraulic cylinders, 101 and 102, and to conduct hydraulic fluid to them without the necessity of providing additional external hoses and tubes between the region of the gimbal ring 64 and the hydraulic cylinders. The surface identified by reference numeral 150 in FIG. 5 is shaped to be received within a cylindrical opening of an associated hydraulic cylinder and provided rotatable support for that cylinder.

Figure 6:
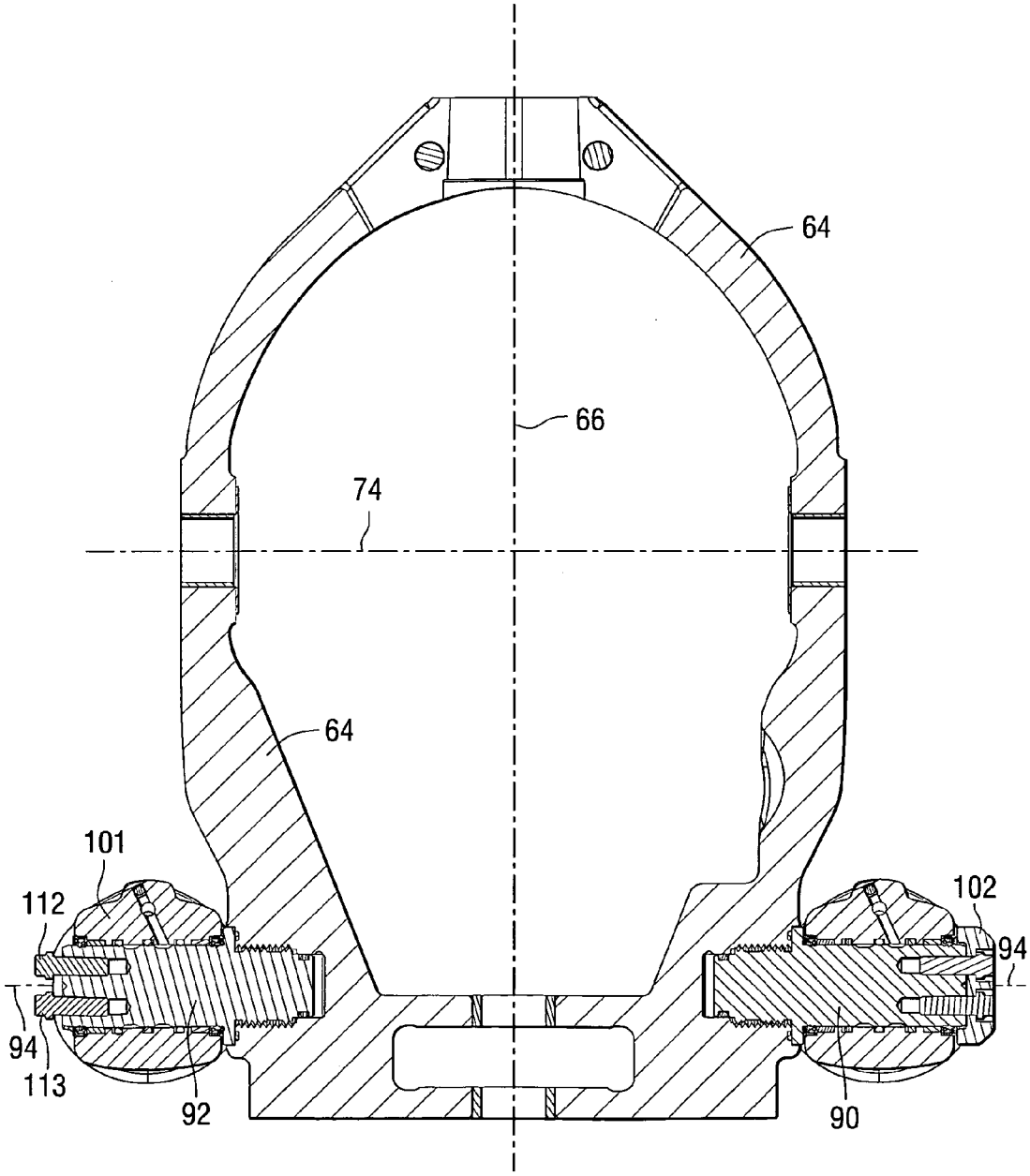
FIG. 6 is a section view of a gimbal ring and two anchor pins associated with two hydraulic cylinders in a preferred embodiment of the present invention.

FIG. 6 is a section view showing a gimbal ring 64, two anchor pins, 90 and 92, and two hydraulic cylinders, 101 and 102, rotatably supported by the anchor pins. The steering axis 66 and the tilt axis 74 are also shown. Similarly, the common axis 94 of the two anchor pins, 90 and 92, is illustrated and identified.

Figure 7:
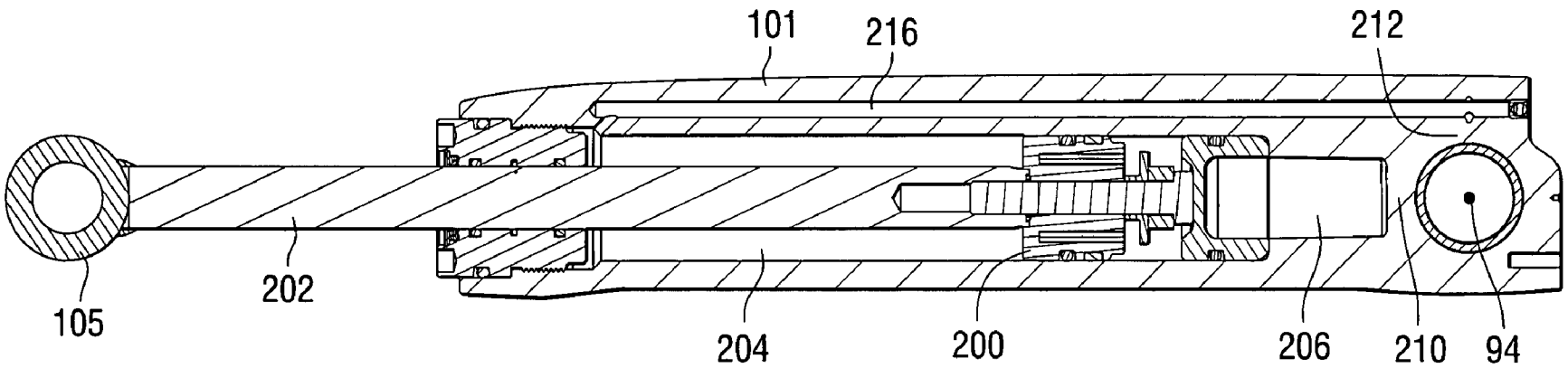
FIGS. 7 and 8 are section views of a hydraulic cylinder used in conjunction with a preferred embodiment of the present invention.
Figure 8:
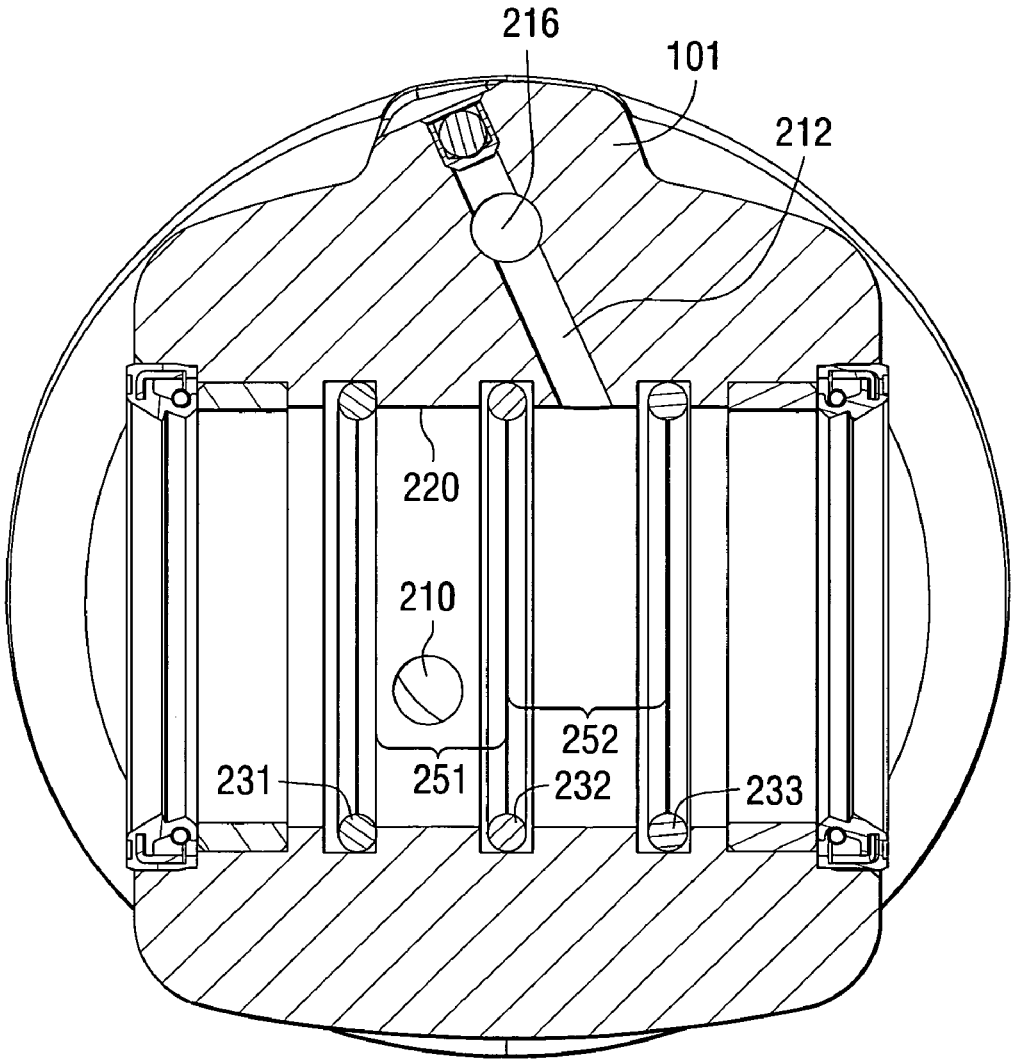

FIG. 7 is a side section view of a hydraulic cylinder 101 used in conjunction with a preferred embodiment of the present invention. FIG. 8 is a section view of the cylinder taken along a plane which is generally perpendicular to the plane of the section view of FIG. 7. It should be understood that the specific structure of the hydraulic cylinder can vary from one embodiment of the present invention to another.

With reference to FIGS. 7 and 8, the hydraulic cylinder 101 is provided with an internally disposed piston 200 that is connected to a piston rod 202 having an end 105 which is also shown in FIG. 4. When pressurized hydraulic fluid is introduced into the space identified by reference numeral 204, the piston 200 will be moved in a direction toward the right in FIG. 7 and the piston rod 202 will be retracted into the housing of the hydraulic cylinder 101. Conversely, if pressurized hydraulic fluid is introduced into the space identified by 206 in FIG. 7, the piston 200 will be moved toward the left and the piston rod 202 will be extended from the cylinder body. Two internal conduits, 210 and 212, are provided to conduct hydraulic fluid into the cavities identified by reference numerals 204 and 206. The conduit identified by reference numeral 216 further conducts hydraulic fluid from passage 212 into the cavity identified by reference numeral 204.

The internal cylindrical surface identified by reference numeral 220 in FIG. 8 is shaped to receive the external cylindrical surface 150 of the anchor pin 90 which is described above in conjunction with FIG. 5. In FIG. 8, three O-rings, 231-233, are shown positioned to define two hydraulic fluid passages. One passage 251 is defined between O-rings 231 and 232. A second passage 252 is defined between O-rings 232 and 233. Hydraulic fluid is conducted through a passage within the gimbal ring 64 and anchor pin 90, such as through passage 146, into the first space 251 between O-rings 231 and 232. This hydraulic fluid is then conducted through passage 210, described above in conjunction with FIG. 7, and into cavity 206. Hydraulic fluid that flows through the passages of the gimbal ring 64, such as passage 136, continues to flow into the space 252 and through conduit 212 and conduit 216 to the cavity identified by reference numeral 204 in FIG. 7.

With reference to FIG. 5, it should be understood that the port and starboard anchor pins, 90 and 92, need not be perfectly symmetrical to each other or identical in configuration to each other. In certain embodiments of the present invention, for example, the conduits 134 and 144, in the port and starboard anchor pins, are reversed in appearance and length. Similarly, the conduits identified by reference numerals 136 and 146 are reversed. This is done for reasons of convenience and to facilitate the positioning of certain tubes and hoses. As a result, the port and starboard anchor pins, 90 and 92, are not interchangeable in a preferred embodiment of the present invention.

As described above in conjunction with FIGS. 2-8, it can be seen that hydraulic fluid is conducted through the body of the gimbal ring 64 and through the bodies of the anchor pins, 90 and 92, into the hydraulic cylinders, 101 and 102, without the need for hoses and tubes in addition to those which conduct the hydraulic fluid from the manifold 80 to the gimbal ring 64. As a result, no hoses or tubes are required to twist or bend about both the steering axis 66 and tilt axis 74.

As described herein, in conjunction to FIGS. 2-8, a hydraulic actuation system for a marine propulsion device, made in accordance with a preferred embodiment of the present invention, comprises a gimbal housing 60 which is attachable to a marine vessel, a gimbal ring 64 which is rotatably attached to the gimbal housing 60 for rotation about a steering axis 66, a bell housing 70 which is rotatably attached to the gimbal ring 64 for rotation about a tilt axis 74, a hydraulic actuator, such as the hydraulic cylinders 101 and 102, connected between the gimbal ring 64 and the bell housing 70, and a conduit connected in fluid communication between a source of hydraulic pressure 10 and the hydraulic actuator. As described above, the attachment of the hydraulic actuator, such as the hydraulic cylinders 101 and 102, can be directly between the gimbal ring 64 and the bell housing 70 or, equivalently, between the gimbal ring 64 and the sterndrive unit which is attached to the bell housing 70.

With continued reference to FIGS. 2-8, the conduit of the preferred embodiment of the present invention has been described in terms of its passage formed through the body of the gimbal ring 64. The conduit in a preferred embodiment of the present invention therefore comprises both the flexible tubes, 82, 84, 86 and 88, and the internal passages formed through the body of the gimbal ring 64. It should be clearly understood that the anchor pins, 90 and 92, are referred to herein as portions of the gimbal ring 64 even though they are threadably connected to it. These internal passages of the conduit have been described above, with particular reference to FIG. 5, as including those passages identified by reference numerals 130, 132, 134, 136, 140, 142, 144, and 146. Those passages function as part of the conduit to direct the hydraulic fluid from the source of hydraulic pressure, or pump 10, to the internal cavities, 204 and 206, of the hydraulic cylinder 101 described above in conjunction with FIG. 7. This passage portion of the conduit extends between the connectors, such as 122 and 124, of the flexible hoses and the internal cavities, 204 and 206, of the hydraulic cylinder 101. It should be understood that certain embodiments of the present invention can be configured to use a single hydraulic cylinder rather than a pair of cylinders as illustrated in FIG. 4.

With continued reference to FIGS. 2-8, a preferred embodiment of the present invention further comprises a fluid manifold 80 that is connected in fluid communication with the conduit and with the source of hydraulic pressure, such as the pump 10. The source of hydraulic pressure is a hydraulic pump in a preferred embodiment of the present invention and the fluid manifold 80 is attached for support to the gimbal housing 60. The hydraulic actuator in a preferred embodiment of the present invention comprises first and second hydraulic cylinders, 101 and 102. First and second anchor pins, 90 and 92, extend coaxially with axis 94, from the gimbal ring 64. The first and second hydraulic cylinders, 101 and 102, are rotatably supported by the first and second anchor pins, 90 and 92, respectively. In a preferred embodiment of the present invention, the first and second anchor pins, 90 and 92, are threaded into the main body of the gimbal ring 64. The passage extends through the first and second anchor pins, 90 and 92, to connect the first and second hydraulic cylinders, 101 and 102, in fluid communication with the source of hydraulic pressure 10. The passage formed through the body of the gimbal ring 64 comprises first and second channels connected in fluid communication between the source of hydraulic pressure 10 and the first hydraulic cylinder 101 and also comprises third and fourth channels connected in fluid communication between the source of hydraulic pressure 10 and the second hydraulic cylinder 102. The first and second channels, which can each comprise internal conduits such as those identified by reference numerals 134 and 144 in FIG. 5, extend through the first anchor pin 90 and third and fourth channels, similarly configured, extend through the second anchor pin 92. The conduit comprises first and second pairs of flexible tubes. These first and second pairs are identified by reference numerals 82 and 84 and by reference numerals 86 and 88, respectively, in FIG. 4. The first and second pairs of flexible tubes are connected between the fluid manifold 80 and the passage formed through the body of the gimbal ring 64.

Although the present invention has been described in particular detail and illustrated with specificity to show a preferred embodiment, it should be understood that alternative embodiments are also within its scope.

We claim:

1. A hydraulic actuation system for a marine propulsion device, comprising:

a gimbal housing which is attachable to a marine vessel;

a gimbal ring which is rotatably attached to said gimbal housing for rotation about a steering axis;

a bell housing which is rotatably attached to said gimbal ring for rotation about a tilt axis;

a hydraulic actuator connected between said gimbal ring and said bell housing;

a conduit connected in fluid communication between a source of hydraulic pressure and said hydraulic actuator, said conduit comprising a passage formed through the body of said gimbal ring, said conduit being configured to conduct hydraulic fluid between said hydraulic pump and said hydraulic actuator and through said passage formed through said gimbal ring;

a fluid manifold connected in fluid communication with said conduit and with said source of hydraulic pressure, said source of hydraulic pressure being a hydraulic pump, said fluid manifold being attached for support to said gimbal housing, said hydraulic actuator comprising first and second hydraulic cylinders;

first and second anchor pins extending coaxially from said gimbal ring, said first and second hydraulic cylinders being rotatably supported by said first and second anchor pins, said first and second anchor pins being threaded into a main body of said gimbal ring, said passage extending through said first and second anchor pins to connect said first and second hydraulic cylinders in fluid communication with said source of hydraulic pressure, said passage formed through the body of said gimbal ring comprising first and second channels connected in fluid communication between said source of hydraulic pressure and said first hydraulic cylinder and third and fourth channels connected in fluid communication between said source of hydraulic pressure and said second hydraulic cylinder.

2. The hydraulic actuation system of claim 1, wherein:

said first and second channels extending through said first anchor pin and said third and fourth channels extending through said second anchor pin.

3. The hydraulic actuation system of claim 1, wherein:

said conduit comprises first and second pairs of flexible tubes connected between said fluid manifold and said passage formed through the body of said gimbal ring.

4. A hydraulic actuation system for a marine propulsion device, comprising:

a gimbal housing which is attachable to a marine vessel;

a gimbal ring which is rotatably attached to said gimbal housing for rotation about a steering axis;

a bell housing which is rotatably attached to said gimbal ring for rotation about a tilt axis;

a hydraulic actuator connected between said gimbal ring and said bell housing;

a conduit connected in fluid communication between a source of hydraulic pressure and said hydraulic actuator, said conduit comprising a passage formed through the body of said gimbal ring, said conduit being configured to conduct hydraulic fluid between said source of hydraulic pressure and said hydraulic actuator and through said passage formed through said gimbal ring;

a fluid manifold connected in fluid communication with said conduit and with said source of hydraulic pressure, said source of hydraulic pressure being a hydraulic pump, said fluid manifold being attached for support to said gimbal housing;

first and second anchor pins extending coaxially from said gimbal ring, said first and second hydraulic cylinders being rotatably supported by said first and second anchor pins, said hydraulic actuator comprising first and second hydraulic cylinders, said first and second anchor pins being threaded into a main body of said gimbal ring, said passage extending through said first and second anchor pins to connect said first and second hydraulic cylinders in fluid communication with said source of hydraulic pressure, said passage formed through the body of said gimbal ring comprising first and second channels connected in fluid communication between said source of hydraulic pressure and said first hydraulic cylinder and third and fourth channels connected in fluid communication between said source of hydraulic pressure and said second hydraulic cylinder, said first and second channels extending through said first anchor pin and said third and fourth channels extending through said second anchor pin.

5. The hydraulic actuation system of claim 4, wherein:

said conduit comprises first and second pairs of flexible tubes connected between said fluid manifold and said passage formed through the body of said gimbal ring.

6. A hydraulic actuation system for a marine propulsion device, comprising:

a gimbal housing which is attachable to a marine vessel;

a gimbal ring which is rotatably attached to said gimbal housing for rotation about a steering axis;

a bell housing which is rotatably attached to said gimbal ring for rotation about a tilt axis;

a hydraulic actuator connected between said gimbal ring and said bell housing; and a conduit connected in fluid communication between a source of hydraulic pressure and said hydraulic actuator, said conduit comprising a passage formed through the body of said gimbal ring, said conduit being configured to conduct hydraulic fluid between said hydraulic pump and said hydraulic actuator and through said passage formed through said gimbal ring, said hydraulic actuator comprising first and second hydraulic cylinders, said passage formed through the body of said gimbal ring comprising first and second channels connected in fluid communication between said source of hydraulic pressure and said first hydraulic cylinder and third and fourth channels connected in fluid communication between said source of hydraulic pressure and said second hydraulic cylinder.

7. The hydraulic actuation system of claim 6, further comprising:

a fluid manifold connected in fluid communication with said conduit and with said source of hydraulic pressure, said source of hydraulic pressure being a hydraulic pump, said fluid manifold being attached for support to said gimbal housing.

8. The hydraulic actuation system of claim 7, further comprising:

first and second anchor pins extending coaxially from said gimbal ring, said first and second hydraulic cylinders being rotatably supported by said first and second anchor pins.

9. The hydraulic actuation system of claim 8, wherein:

said first and second anchor pins are threaded into a main body of said gimbal ring.

10. The hydraulic actuation system of claim 9, wherein:

said passage extends through said first and second anchor pins to connect said first and second hydraulic cylinders in fluid communication with said source of hydraulic pressure.

11. The hydraulic actuation system of claim 10, wherein:

said first and second channels extending through said first anchor pin and said third and fourth channels extending through said second anchor pin.

12. The hydraulic actuation system of claim 11, wherein:

said conduit comprises first and second pairs of flexible tubes connected between said fluid manifold and said passage formed through the body of said gimbal ring.

* * * * *